US006223626B1

(12) United States Patent
West

(10) Patent No.: US 6,223,626 B1
(45) Date of Patent: May 1, 2001

(54) CORK REMOVAL DEVICE

(76) Inventor: Francis W. West, 47 Roxeth Hill, Harrow on the Hill, London HA2 OJP (GB)

( * ) Notice: Subject to any disclaimer, the term of this patent is extended or adjusted under 35 U.S.C. 154(b) by 0 days.

(21) Appl. No.: 09/497,927

(22) Filed: Feb. 4, 2000

(51) Int. Cl.[7] ..... B67B 7/04
(52) U.S. Cl. ..... 81/3.48; 81/3.2
(58) Field of Search ..... 81/3.2, 3.48

(56) References Cited

U.S. PATENT DOCUMENTS

| | | | | |
|---|---|---|---|---|
| 1,921,811 | * | 8/1933 | Eger | 81/3.2 |
| 2,729,124 | * | 1/1956 | Farandatos | 81/3.2 |
| 3,192,803 | * | 7/1965 | Federighi | 81/3.2 |
| 4,791,834 | * | 12/1988 | Federighi | 81/3.2 |
| 5,012,703 | * | 5/1991 | Reinbacher | 81/3.2 X |

FOREIGN PATENT DOCUMENTS

| | | | | |
|---|---|---|---|---|
| 1432292 | * | 4/1969 | (DE) | 81/3.2 |
| 986984 | * | 3/1965 | (GB) | 81/3.2 |

* cited by examiner

*Primary Examiner*—James G. Smith

(57) ABSTRACT

A cork removal device for injecting air between a cork and the contents of a bottle to force the cork out of the bottle. The cork removal device includes a base portion and a cap. The base portion has a bottom wall. The bottom wall has a peripheral edge. A peripheral wall is coupled to and extends away from the peripheral edge. The bottom wall has an aperture therethrough. A needle for inserting into a cork has a blunt end and a sharp end. The blunt end of the needle is fixedly mounted to the bottom wall of the base portion and is in communication with the aperture in the bottom wall. The needle extends away from the interior of the base portion. The needle has a lumen. The cap is substantially solid. The cap has a top surface and a bottom surface. An annular slot in the cap receives the peripheral wall. The annular slot extends into the cap from the bottom surface.

15 Claims, 2 Drawing Sheets

CORK REMOVAL DEVICE

BACKGROUND OF THE INVENTION

1. Field of the Invention

The present invention relates to cork removers and more particularly pertains to a new cork removal device for injecting air between a cork and the contents of a bottle to force the cork out of the bottle.

2. Description of the Prior Art

The use of cork removers is known in the prior art. More specifically, cork removers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,012,703; U.S. Pat. No. 4,791,834; U.S. Pat. No. 5,020,395; U.S. Pat. No. 4,464,956; U.S. Pat. No. 4,317,390; and U.S. Des. Pat. No. 268,245.

While these devices fulfill their respective, particular objectives and requirements, the aforementioned patents do not disclose a new cork removal device. The inventive device includes a base portion and a cap. The base portion has a bottom wall. The bottom wall has a peripheral edge. A peripheral wall is coupled to and extends away from the peripheral edge. The bottom wall has an aperture therethrough. A needle for inserting into a cork has a blunt end and a sharp end. The blunt end of the needle is fixedly mounted to the bottom wall of the base portion and is in communication with the aperture in the bottom wall. The needle extends away from the interior of the base portion. The needle has a lumen. The cap is substantially solid. The cap has a top surface and a bottom surface. An annular slot in the cap receives the peripheral wall. The annular slot extends into the cap from the bottom surface.

In these respects, the cork removal device according to the present invention substantially departs from the conventional concepts and designs of the prior art, and in so doing provides an apparatus primarily developed for the purpose of injecting air between a cork and the contents of a bottle to force the cork out of the bottle.

SUMMARY OF THE INVENTION

In view of the foregoing disadvantages inherent in the known types of cork removers now present in the prior art, the present invention provides a new cork removal device construction wherein the same can be utilized for injecting air between a cork and the contents of a bottle to force the cork out of the bottle.

The general purpose of the present invention, which will be described subsequently in greater detail, is to provide a new cork removal device apparatus and method which has many of the advantages of the cork removers mentioned heretofore and many novel features that result in a new cork removal device which is not anticipated, rendered obvious, suggested, or even implied by any of the prior art cork removers, either alone or in any combination thereof.

To attain this, the present invention generally comprises a base portion and a cap. The base portion has a bottom wall. The bottom wall has a peripheral edge. A peripheral wall is coupled to and extends away from the peripheral edge. The bottom wall has an aperture therethrough. A needle for inserting into a cork has a blunt end and a sharp end. The blunt end of the needle is fixedly mounted to the bottom wall of the base portion and is in communication with the aperture in the bottom wall. The needle extends away from the interior of the base portion. The needle has a lumen. The cap is substantially solid. The cap has a top surface and a bottom surface. An annular slot in the cap receives the peripheral wall. The annular slot extends into the cap from the bottom surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cork removal device apparatus and method which has many of the advantages of the cork removers mentioned heretofore and many novel features that result in a new cork removal device which is not anticipated, rendered obvious, suggested, or even implied by any of the prior art cork removers, either alone or in any combination thereof.

It is another object of the present invention to provide a new cork removal device which may be easily and efficiently manufactured and marketed.

It is a further object of the present invention to provide a new cork removal device which is of a durable and reliable construction.

An even further object of the present invention is to provide a new cork removal device which is susceptible of a low cost of manufacture with regard to both materials and labor, and which accordingly is then susceptible of low prices of sale to the consuming public, thereby making such cork removal device economically available to the buying public.

Still yet another object of the present invention is to provide a new cork removal device which provides in the apparatuses and methods of the prior art some of the advantages thereof, while simultaneously overcoming some of the disadvantages normally associated therewith.

Still another object of the present invention is to provide a new cork removal device for injecting air between a cork and the contents of a bottle to force the cork out of the bottle.

Yet another object of the present invention is to provide a new cork removal device which includes a base portion and a cap. The base portion has a bottom wall. The bottom wall has a peripheral edge. A peripheral wall is coupled to and extends away from the peripheral edge. The bottom wall has an aperture therethrough. A needle for inserting into a cork has a blunt end and a sharp end. The blunt end of the needle is fixedly mounted to the bottom wall of the base portion and is in communication with the aperture in the bottom wall. The needle extends away from the interior of the base portion. The needle has a lumen. The cap is substantially solid. The cap has a top surface and a bottom surface. An annular slot in the cap receives the peripheral wall. The annular slot extends into the cap from the bottom surface.

Still yet another object of the present invention is to provide a new cork removal device that is actuated by pushing the cap into the base portion which allows for easy leverage.

Even still another object of the present invention is to provide a new cork removal device that uses a needle and creates very little risk of damaging the cork.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
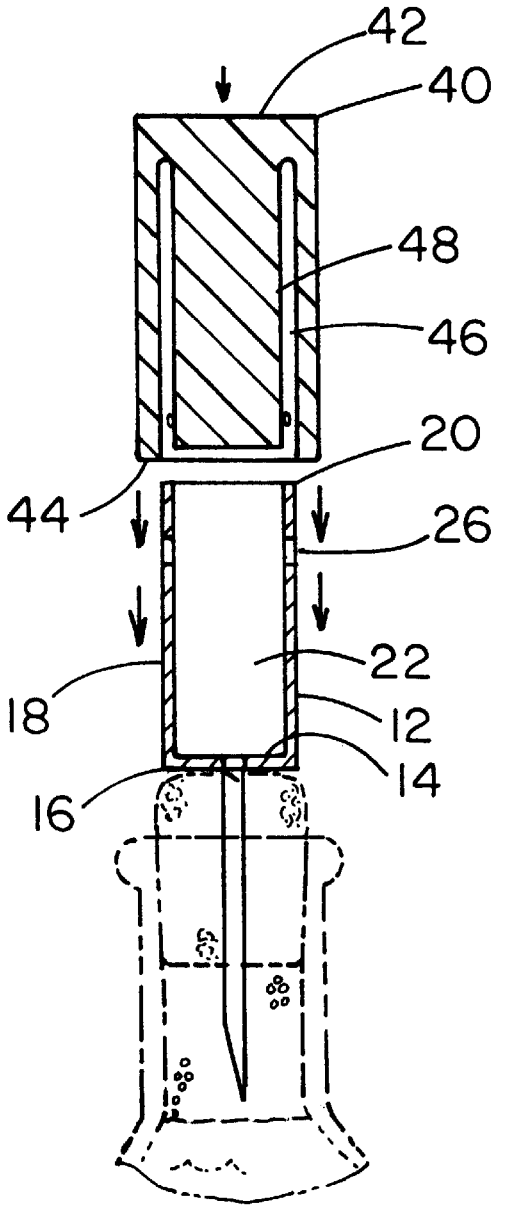
FIG. 1 is a schematic side cross-sectional view of a new cork removal device according to the present invention.
Figure 2:
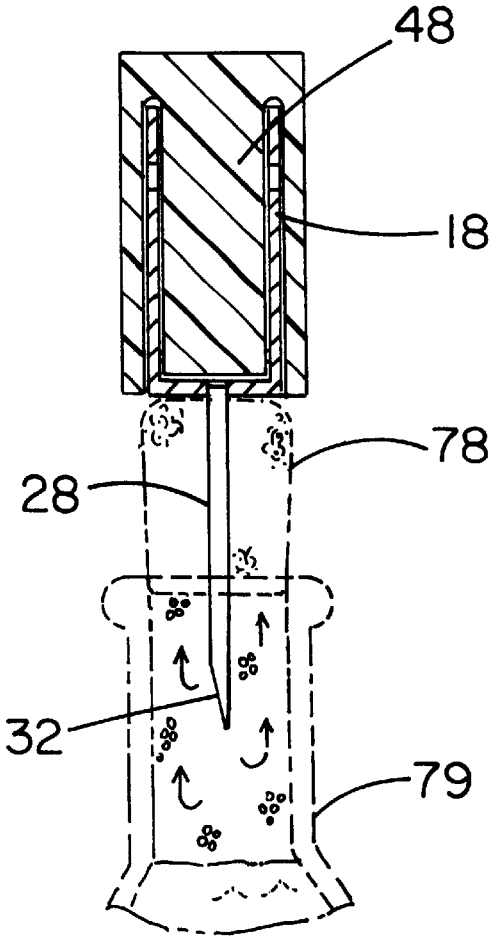
FIG. 2 is a schematic side cross-sectional view of the present invention.
Figure 3:
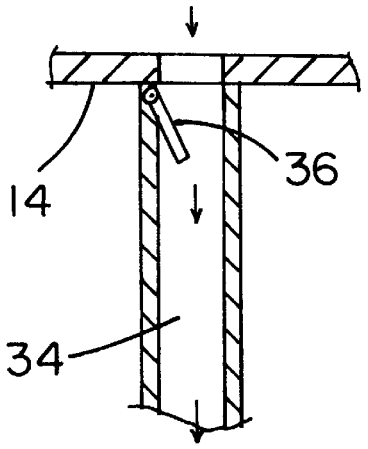
FIG. 3 is a schematic enlarged cross-sectional view of the valve in the open position of the present invention.
Figure 4:
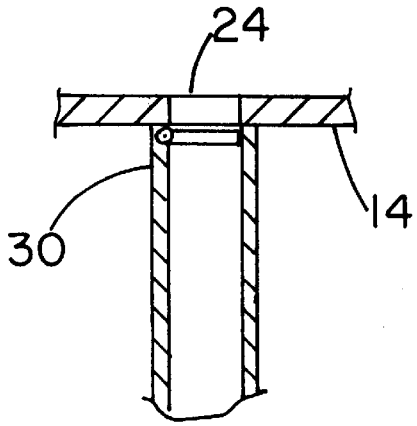
FIG. 4 is a schematic enlarged cross-sectional view of the valve in the closed position of the present invention.
Figure 5:
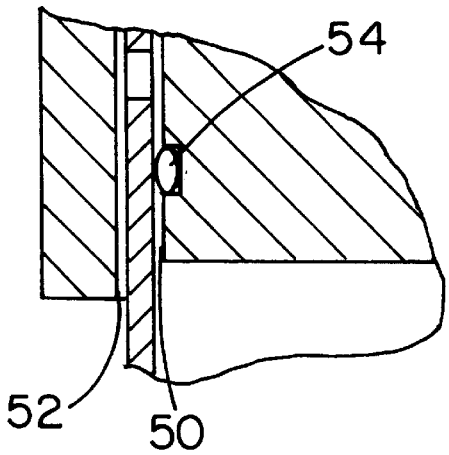
FIG. 5 is a schematic enlarged view of the seal of the present invention.

With reference now to the drawings, and in particular to FIGS. 1 through 5 thereof, a new cork removal device embodying the principles and concepts of the present invention and generally designated by the reference numeral 10 will be described.

As best illustrated in FIGS. 1 through 5, the cork removal device 10 generally comprises a base portion 12 and a cap 40.

The base portion 12 has a bottom wall 14. The bottom wall 12 has a peripheral edge 16. A peripheral wall 18 is coupled to and extends away from the peripheral edge 16. The peripheral wall has a top edge 20. The bottom wall 14 and the peripheral wall 18 bound an interior 22 of the base portion 12. The bottom wall 14 has a generally planar circular shape. The bottom wall 14 has an aperture 24 therethrough.

A plurality of bores 26 extends into the peripheral wall 18. Each of the bores 26 is generally located adjacent to the top edge 20 of the peripheral wall 18.

A needle 28 for inserting into a cork 78 has a blunt end 30 and a sharp end 32. The blunt end 30 of the needle 28 is fixedly mounted to the bottom wall 14 of the base portion 12 and in communication with the aperture 24 in the bottom wall 14. The needle 28 is generally located in a central portion of the bottom wall 14. The needle 28 extends away from the interior 22 of the base portion 12. The needle 28 has a lumen 34. Air flows from the interior 22 of the base portion 12 through the needle 28.

A valve 36 controls air flow through the lumen 34 of the needle. The valve 36 is located in the lumen 34 of the needle 28. The valve 36 is generally adjacent to the blunt end 30 of the needle 28. The valve 36 is adapted to allow air flow through the lumen 34 in only a first direction. The first direction of air flow is from the interior 22 of the base portion 12 through the needle 28 toward the sharp end 32. The valve prevents air from re-entering the interior 22 of the base portion 12 when the cork 78 is being removed.

The cap 40 is substantially solid. The cap 40 has a top surface 42 and a bottom surface 44. The top surface 42 is generally planar. The cap 40 has a generally circular cross-section taken transverse to a line extending between the top 42 and bottom 44 surfaces.

An annular slot 46 in the cap 40 receives the peripheral wall 18. The annular slot 46 extends into the cap 40 from the bottom surface 44. The annular slot 46 forms an interior portion 48 of the cap 40. The annular slot 46 has a diameter generally equal to a diameter of the bottom wall 14 of the base portion 12. The annular slot 46 has an inner wall 50 and an outer wall 52. The inner wall 50 has an annular seal 54 thereon, which is preferably is located generally adjacent to the bottom surface 44 of the cap 40.

In use, the needle 28 is inserted into and through the cork 78 such that the sharp end 32 is in communication with the interior of the bottle 79. The cap 40 is placed over the bottom portion 12 such that the annular slot 46 receives the peripheral wall 18. Pressing the interior portion 48 of the cap 40 into the interior 22 of the base portion 12 forces air from the interior 22 of the base portion 12 through the needle 28 and into the bottle 79 between the cork 78 and the contents of the bottle 79. The air forced into the bottle forces the cork 78 out of the bottle 79.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cork removal device for removing a cork from a bottle, said device comprising:

a base portion;

a cap;

said base portion having a bottom wall, said bottom wall having a peripheral edge, a peripheral wall being coupled to and extending away from said peripheral edge, said bottom wall having an aperture therethrough;

a needle for inserting into the cork, said needle having a blunt end and a sharp end, said blunt end of said needle being fixedly mounted to said bottom wall of said base portion in communication with said aperture in said bottom wall, said needle extending away from said interior of said base portion, said needle having a lumen;

said cap being substantially solid, said cap having a top surface and a bottom surface;

an annular slot in said cap for receiving said peripheral wall, said annular slot extending into said cap from said bottom surface;

said peripheral wall having a top edge, an interior of said base portion being bounded by said bottom wall and said peripheral wall, said bottom wall having a generally planar circular shape; and a plurality of bores extending into said peripheral wall, each of said bores being generally located adjacent to said top edge of said peripheral wall.

2. The cork removal device for removing a cork from a bottle as in claim 1, wherein said needle is generally located in a central portion of said bottom wall, wherein air flows from said interior of said base portion through said needle.

3. The cork removal device for removing a cork from a bottle as in claim 1, further comprising:

a valve for controlling air flow through the lumen of said needle, said valve being located in the lumen of said needle.

4. The cork removal device for removing a cork from a bottle as in claim 3, wherein said valve is generally adjacent to said blunt end of said needle, said valve being adapted to allow air flow through said lumen in only a first direction, said first direction of air flow being from said interior of said base portion through said needle toward said sharp end.

5. The cork removal device for removing a cork from a bottle as in claim 4, wherein said cap has a generally circular cross-section taken transverse to a line extending between said top and bottom surfaces.

6. The cork removal device for removing a cork from a bottle as in claim 1, wherein said annular slot forms an interior portion of said cap, said annular slot having a diameter generally equal to a diameter of said bottom wall of said base portion.

7. The cork removal device for removing a cork from a bottle as in claim 6, wherein said annular slot has an inner wall and an outer wall, said inner wall having an annular seal thereon, said annular seal being located generally adjacent to said bottom surface of said cap.

8. A cork removal device for removing a cork from a bottle, said device comprising:

a base portion;

a cap;

said base portion having a bottom wall, said bottom wall having a peripheral edge, a peripheral wall being coupled to and extending away from said peripheral edge, said peripheral wall having a top edge, an interior of said base portion being bounded by said bottom wall and said peripheral wall, said bottom wall having a generally planar circular shape, said bottom wall having an aperture therethrough;

a plurality of bores extending into said peripheral wall, each of said bores being generally located adjacent to said top edge of said peripheral wall;

a needle for inserting into the cork, said needle having a blunt end and a sharp end, said blunt end of said needle being fixedly mounted to said bottom wall of said base portion in communication with said aperture in said bottom wall, said needle being generally located in a central portion of said bottom wall, said needle extending away from said interior of said base portion, said needle having a lumen, wherein air flows from said interior of said base portion through said needle;

a valve for controlling air flow through the lumen of said needle, said valve being located in the lumen of said needle, said valve being generally adjacent to said blunt end of said needle, said valve being adapted to allow air flow through said lumen in only a first direction, said first direction of air flow being from said interior of said base portion through said needle toward said sharp end;

said cap being substantially solid, said cap having a top surface and a bottom surface, said top surface being generally planar, said cap having a generally circular cross-section taken transverse to a line extending between said top and bottom surfaces;

an annular slot in said cap for receiving said peripheral wall, said annular slot extending into said cap from said bottom surface, said annular slot forming an interior portion of said cap, said annular slot having a diameter generally equal to a diameter of said bottom wall of said base portion, said annular slot having an inner wall and an outer wall, said inner wall having an annular seal thereon, said annular seal being located generally adjacent to said bottom surface of said cap; and wherein said needle is inserted into and through the cork such that said sharp end is in communication with the interior of said bottle, wherein said cap is placed over said bottom portion such that said annular slot receives said peripheral wall, wherein pressing said interior portion of said cap into said interior of said base portion forces air from said interior of said base portion through said needle and into said bottle between the cork and the contents of the bottle such that air in the bottle forces the cork out of the bottle.

9. A cork removal device for removing a cork from a bottle, said device comprising:

a base portion;

a cap;

said base portion having a bottom wall, said bottom wall having a peripheral edge to define an interior, a peripheral wall being coupled to and extending away from said peripheral edge, said bottom wall having an aperture therethrough;

a needle for inserting into the cork, said needle having a relatively blunt end and a relatively sharp end, said relatively blunt end of said needle being fixedly mounted to said bottom wall of said base portion in communication with said aperture in said bottom wall, said needle extending away from said interior of said base portion, said needle having a lumen;

said cap having a top surface and a bottom surface;

an annular slot formed in said bottom surface of said cap for receiving said peripheral wall of said base portion, a portion of said cap inside said annular slot being adapted for insertion into said interior of said base portion for displacing air in said interior;

said peripheral wall of said base portion having a top edge; and a plurality of bores extending into said peripheral wall, each of said bores being generally located adjacent to said top edge of said peripheral wall.

10. The cork removal device for removing a cork from a bottle as in claim 9, wherein said needle is generally located in a central portion of said bottom wall, wherein air flows from said interior of said base portion through said needle.

11. The cork removal device for removing a cork from a bottle as in claim 9, further comprising:

a valve for controlling air flow through the lumen of said needle, said valve being located in the lumen of said needle.

12. The cork removal device for removing a cork from a bottle as in claim 11, wherein said valve is generally adjacent to said blunt end of said needle, said valve being adapted to allow air flow through said lumen in only a first direction, said first direction of air flow being from said interior of said base portion through said needle toward said sharp end.

13. The cork removal device for removing a cork from a bottle as in claim 12, wherein said cap has a generally circular cross-section taken transverse to a line extending between said top and bottom surfaces.

14. The cork removal device for removing a cork from a bottle as in claim 9, wherein said annular slot forms an interior portion of said cap, said annular slot having a diameter generally equal to a diameter of said bottom wall of said base portion.

15. The cork removal device for removing a cork from a bottle as in claim 14, wherein said annular slot has an inner wall and an outer wall, said inner wall having an annular seal thereon, said annular seal being located generally adjacent to said bottom surface of said cap.

* * * * *